US006093159A

United States Patent [19]

Racoosin

[11] Patent Number: 6,093,159

[45] Date of Patent: Jul. 25, 2000

[54] FREELY ROTATIONAL MANUAL BODY MASSAGER

[76] Inventor: Eric A. Racoosin, 22912 Cantara La., Laguna Niguel, Calif. 92607

[21] Appl. No.: 09/042,607

[22] Filed: Mar. 16, 1998

[51] Int. Cl.[7] ..... A61H 15/00

[52] U.S. Cl. ..... 601/131; 601/118; 601/125

[58] Field of Search ..... 601/118, 133, 601/134, 135, 136, 137, 122, 124, 125, 128, 131, 132, 112, 113, 116, 117, 40; 482/44, 47, 49; 345/163; 297/318; 16/21–30, 45; 403/90, 71, 76, 77, 121; D24/200–214; 15/159–161, 106, 107, 110

[56] References Cited

U.S. PATENT DOCUMENTS

| | | | |
|---|---|---|---|
| D. 341,426 | 11/1993 | Hubbard | D24/211 |
| D. 363,554 | 10/1995 | Psaros | D24/200 |
| D. 387,174 | 12/1997 | Gladieux, Jr. | D24/214 |
| 598,773 | 2/1898 | Figge | 601/118 |
| 754,925 | 3/1904 | Zar-Adusht-Hanish | 601/131 |
| 1,312,863 | 8/1919 | Naruszewicz | 16/26 |
| 1,573,362 | 2/1926 | Stovall | 482/148 |
| 1,705,249 | 3/1929 | Henry | 601/137 |
| 2,709,432 | 5/1955 | Ackerman | 601/131 |
| 2,797,685 | 7/1957 | Packwood | 601/131 |
| 2,988,084 | 6/1961 | Douglas | 601/122 |
| 3,060,928 | 10/1962 | Lowe | 601/128 |
| 3,381,330 | 5/1968 | Aninger | 16/26 |
| 3,672,358 | 6/1972 | Majewski | 601/132 |
| 4,382,637 | 5/1983 | Blackburn et al. | 16/24 |
| 4,411,421 | 10/1983 | Hershberger | 482/121 |
| 4,516,774 | 5/1985 | Nankivell | 473/518 |
| 4,527,924 | 7/1985 | Asberg | 403/76 |
| 4,590,926 | 5/1986 | Courtin | D24/41 |
| 5,092,703 | 3/1992 | Kobayashi | 403/122 |
| 5,105,802 | 4/1992 | Pokorny | 601/122 |
| 5,125,757 | 6/1992 | Morrison et al. | 601/131 |
| 5,131,384 | 7/1992 | Obagi | 601/118 |
| 5,144,756 | 9/1992 | Miscione | 34/60 |
| 5,465,449 | 11/1995 | Lewkowicz | 15/106 |
| 5,605,533 | 2/1997 | Badilla | 601/103 |
| 5,841,425 | 11/1998 | Zenz, Sr. | 345/163 |

FOREIGN PATENT DOCUMENTS

| | | | |
|---|---|---|---|
| 651965 | 1/1963 | Italy | 601/131 |
| 11000 | 4/1895 | United Kingdom | 601/131 |
| 314282 | 6/1929 | United Kingdom | 601/131 |

*Primary Examiner*—Stephen R. Crow
*Assistant Examiner*—Justine R. Yu
*Attorney, Agent, or Firm*—Richard T. Holzmann

[57] ABSTRACT

A freely rotational ball actuated manual body massager designed to fit comfortably in the user's hand. The pressure of a specially designed density ball which spins three-dimensionally creates a motion resembling the action of the balls of the fingers of a massage therapist's hand. The body of the device can be made by plastic injection of an aesthetically appealing durable material. The ball is designed to rotate freely inside its housing and held there by a removable retainer resembling the action of a ball of a computer mouse or the dispenser head of a roll-on anti-perspirant. Several different retainers of Teflon® may be used to insure intimate contact between ball and retainer providing minimal friction and maximal free rotation with ease, efficiency and economy of manufacture.

8 Claims, 5 Drawing Sheets

FREELY ROTATIONAL MANUAL BODY MASSAGER

FIELD OF THE INVENTION

This present invention is related in general to a manual body massage device, and more particularly, to one having a freely rotational ball as the contact mechanism.

BACKGROUND OF THE INVENTION

The body heals microtrauma to tendons, muscles and ligaments by generating collagen, a connective-tissue protein that your body uses as a cement. Massage aids the healing process and hastens recovery by breaking-up excess collagen materials between healthy muscle fibers, increasing circulation, flushing out lactic acid and other toxins that cause muscle stiffness and soreness, and improves circulation of blood and lymph fluids as well as helping maintain muscle length. Massage also helps identify irregularities and even heals damaged tissue that could turn into severe problems if not treated or allowed to recover.

Massage techniques are designed to benefit muscles by warming and softening tissue, realigning muscle fibers and help heal scar tissue. Regular massage can identify tender areas before they develop injuries, stretch and relax muscles, relieve pain and spasms, improve range of motion and restore suppleness and elasticity.

Acupressure is an ancient healing art in which finger pressure is applied to specific sensitive points (trigger points) on the body. The art of massage therapy similarly involves the manipulation of the muscles of the body with the balls of the fingers, for example, making circular movements while pressing, having a prominent role in the relief of pain and stress. Furthermore, in other circumstances the elbow and fist are necessary to achieve relief. While one's hands are the ultimate tool, these mechanisms can be enhanced by the use of a mechanical device whereby the therapy is not only improved but the strain on the therapist is considerably reduced.

Experienced therapists must frequently exercise their hands due to the fact that they become extremely tired after a strenuous massage. Furthermore, therapists are subject to a number of problems related to their profession such as carpal tunnel syndrome, tendonitis, ligament strain, muscle spasm and inflammation, and problems with their wrist and forearm flexons and extensors.

There is no official way to do massage and consequently, there are a wide assortment of massage tools and gadgets being marketed in all sizes, shapes and prices. Some of the simple favorites are the Bolo which has a short wooden shaft wherein the mushroom-shaped end fits into the palm of the hand, and the other slightly rounded end is pressed into the "trigger points" in tight spots such as in the shoulder, neck and top of the instep. A similar device is the Knobble™. Another is the Bongers™ which consists of a rubberized ball on a springy metal handle. Others available are electrically actuated and heavy duty to direct vibrations deep into the muscles.

There have been attempts in the prior art to address this subject, for example, in Design Pat. No. 273,042 a massage roller is disclosed similar in configuration to a child's simple auto having four wheels. Such design however, does not solve the problem of the transfer of circular pressure since too great a distance must be covered when spot circular motion is indicated. Similar problems exist with Design Pat. Nos. 359,360 and 361,133 disclosing rolling swivel hand-grip massagers.

In another vein, Design Pat. Nos. 262,908; 264,754; and 269,376 disclose various hand-held body massagers having multiple balls as the contact points. However, it is unclear whether these balls are stationary or move but, in any event, they cannot provide necessary point contact because of the multiplicity of the balls. The devices of this invention, therefore, comprise only a single ball in a housing. In addition, all of these designs suffer from the nature of their handles in that great strain is placed on the massage therapist's wrist and forearm.

Other relevant art can be found in U.S. Pat. No. 4,605,554 granted to Prussia et al which discloses a roll-on deodorant applicator, and a device for securing a mouse ball as disclosed in U.S. Pat. No. 5,610,632 issued to Perry. Furthermore, instead of a handle, the instant invention allows the use of the full palm of the hand for control thereby reducing wrist problems of the therapist.

In the context of this known technology, there remains the need for a product to solve the problems associated with hand-held body massagers. Consequently, there has been and is now a long-felt, unmet need to provide a low-cost, simple, easily manufactured device. Furthermore, there appears to be no suggestion in the prior art of making a product directed to the solution of these problems such as the inability to provide deep pressure at a point or with circular motion while, at the same time, easing the discomfort to the wrist of the massage therapist.

Thus, there are several objects and advantages of the instant invention as set forth below. A primary object of the invention is to provide a spherical, freely rotational and non-binding contact point between subject and therapist which closely simulates the technique of a massage therapist. Another object is to provide a housing for the contact ball which is designed to withstand the application of pressure while not binding the contact point.

Still another object is to provide indentations in the housing to accommodate the therapist's hand including recesses for fingertips to direct pressure away from the palm and towards the fingertips. A further object is to provide a strap to allow the therapist to maintain full control of the device to enhance technique.

Other objects are to provide a device which is relatively unbreakable and made of non-porous materials to insure sterility; to provide a device that is specifically constructed for the neck and trapezius areas, as well as for isolated muscles, trigger points and the feet; and to do the above at a price affordable to the average person.

SUMMARY OF THE INVENTION

This non-electrical invention is designed to simulate the techniques used by a trained massage therapist in kneading muscles and thereby alleviate muscle stress in the human body both for the subject of the massage and the therapist.

According to the teaching of the present invention, a housing (1) having a first indentation on its top surface shaped to receive four fingers of a hand for directing pressure away from the palm and towards the fingertips, formed with a stop (5) allowing most of the pressure from the user's hand to be forced into the stop (5) for accuracy, stability and precise control for transmitting pressure from the fingers rather than from the wrist and for preventing forward slippage of said fingers, and second and third indentations (4) on sides of the housing (1) shaped to receive a right or lefthanded thumb, and having a bottom wall that defines a first circular opening having a concentric circular protrusion (20) associated therewith; a strap (3), preferably of nylon webbing, inserted in a top surface of the housing (1) having a hole (2) formed therethrough for threading through said hole (2) for placement across the back of the hand allowing transmission of pressure from the fingers; a ball (7) freely rotatable in the housing (1) and projecting through said first circular opening (10) said ball (7) being of slightly lesser diameter than said first circular opening (10); and means for retaining (6) attached to said concentric circular protrusion (20) formed with a circular opening concentric with said first circular opening of lesser diameter than said ball (7) for retaining said ball (7) in the housing (1) whereby said ball (7) is held captive in the housing (1) and removal from said means for retaining (6) is resisted.

The housing (1) is formed from a plastic such as ABS, polystyrene or polypropylene for strength and durability, while the ball (7) is formed from polystyrene, natural rubber or Neoprene® with polystyrene preferred for providing the non-permeable and resiliency properties required for cleanliness, ease of installation and removal from said means for retaining (6). A plurality of balls (7) and matching means for retaining (6) them are also encompassed within this invention.

A number of different means for retaining the balls within the housing and connecting them thereto while allowing them to project through the retainer are disclosed. The primary objective is to insure that a ball will freely rotate and to this end the retainers and any inserts are made of Teflon® whose lubricity characteristics are satisfactory in contact with a polystyrene ball for example.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
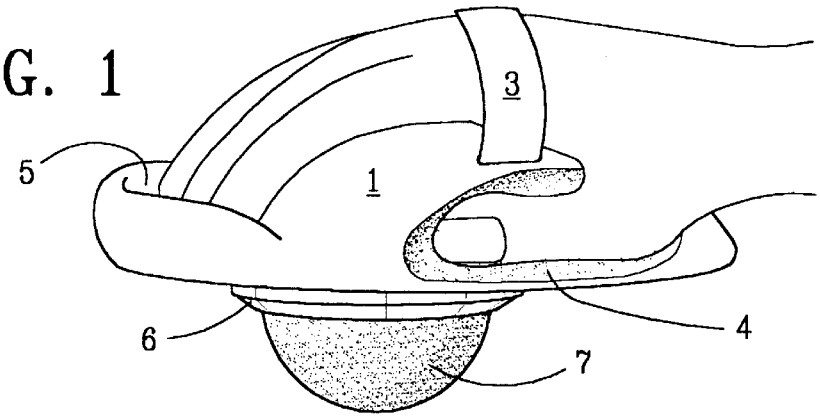
FIG. 1 is a top perspective view of a massager showing the position of the hand.
Figure 2:
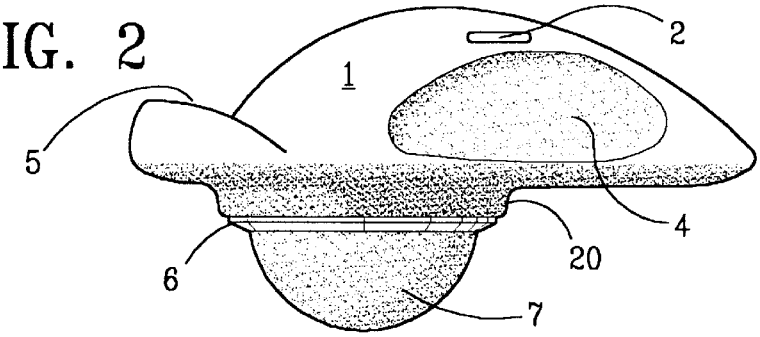
FIG. 2 is a side view of a massager.
Figure 3:
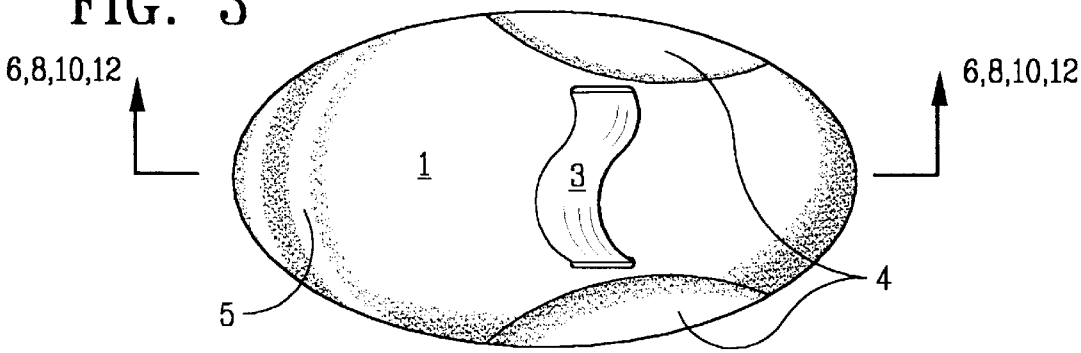
FIG. 3 is a top view of FIG. 2.
Figure 4:
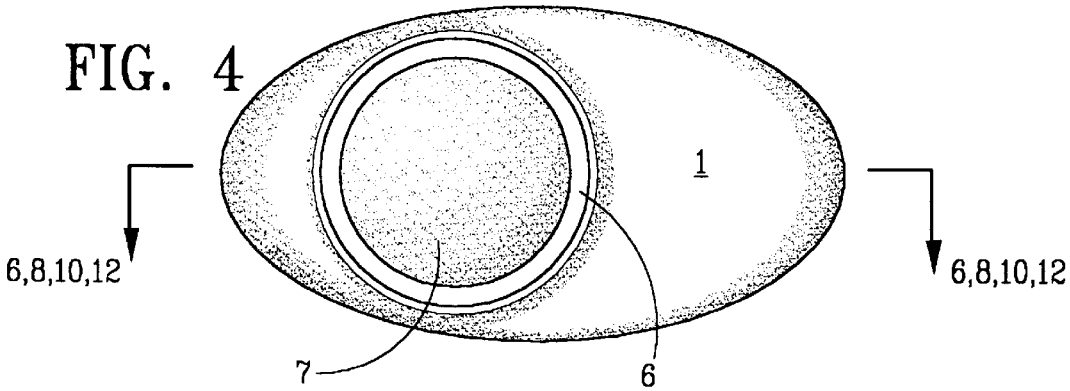
FIG. 4 is a bottom view of FIG. 2.

The focus of the instant invention is directed to a hand-held device for implementing massage therapy having a housing (1) whose top surface is shaped to comfortably accommodate the palm, fingers and thumb (4) of a hand, while the bottom surface has an opening therein to receive and hold a freely rotational ball (7) and means for retaining (6) the ball for transmitting pressure from the fingers and not from the wrist to the ball (7) when massaging a subject.

FIGS. 1–4 show generalized perspective, side, top, and bottom views of the device with a hand in place. The housing (1) is formed from a plastic, although even wood or a light metal may be used, selected from the group consisting of ABS, polystyrene and polypropylene with polystyrene being preferred. The housing (1) is molded, although it may also be machined, shaped to have a first indentation for receiving four fingers of a hand on its top surface to direct pressure away from the palm and towards the fingertips and formed with a stop (5) allowing most of the pressure from the user's hand to be forced into the stop (5) for accuracy, stability and precise control for transmitting pressure from the fingers rather than from the wrist and for preventing forward slippage of said fingers. Second and third indentations (4) shaped to receive a right or left-handed thumb are formed on the sides. A strap (3) across the back of the hand which is inserted through strap hole (2) in the housing (1) provides extra stability for maximum control. The strap (3) is preferably of nylon although it may also be of Krayton® or any other suitable fabric. The housing (1) has an approximately hemispherical hole hollowed out within its lower portion resulting in a circular opening being defined in its bottom wall as shown in FIG. 6.

Also illustrated in FIGS. 1–4 is a protrusion (20) from the bottom wall of housing (1) further defining the circular hole for receiving a ball (7) and providing a site for a retainer (6) to hold the ball (7) in place while allowing it to rotate freely when in use. To reduce cost, a hollow ball has proven to be less expensive and as effective as a solid one.

Figure 5:
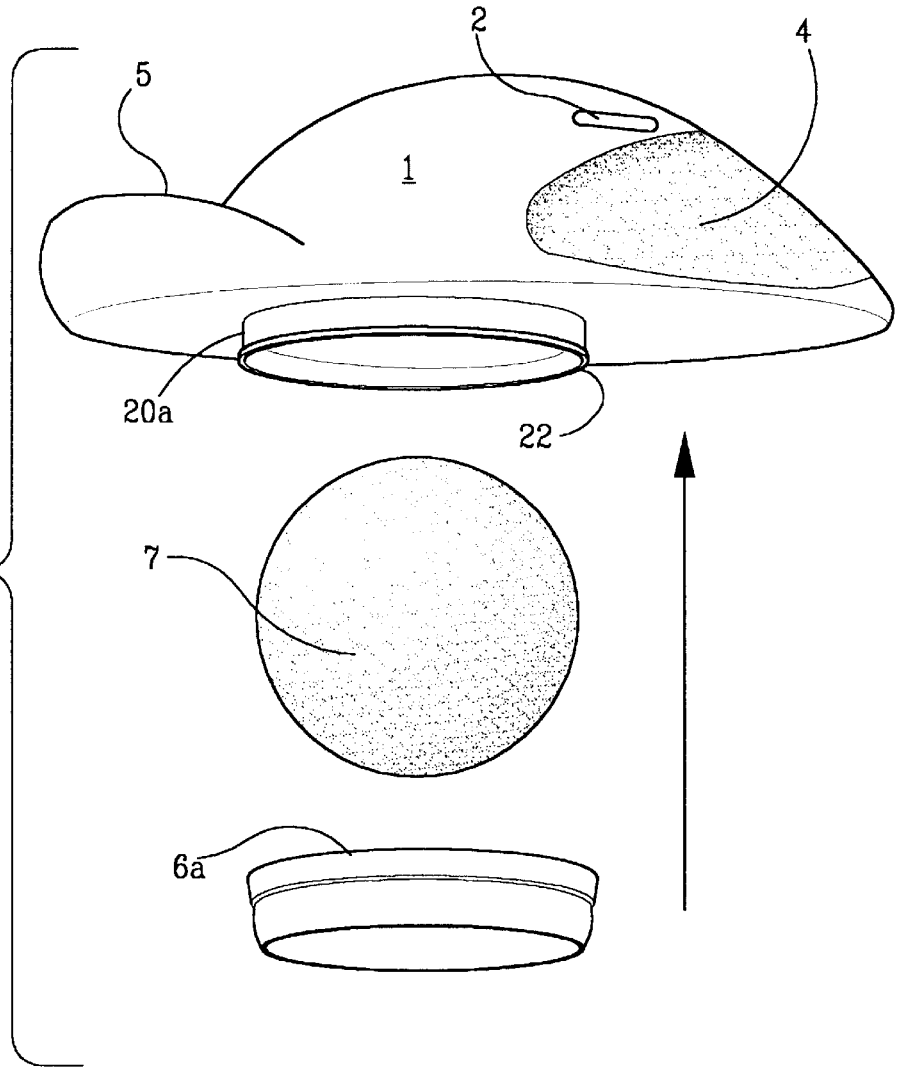
FIG. 5 is an exploded bottom perspective view of a first embodiment of a massager.
Figure 6:
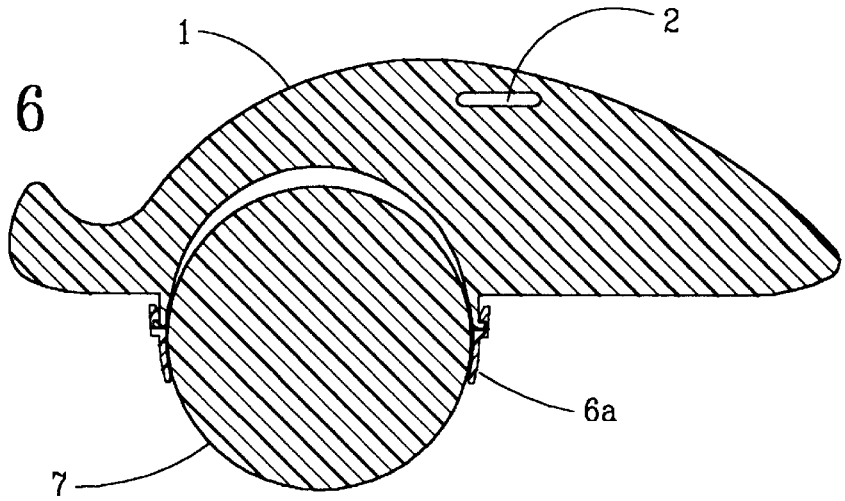
FIG. 6 is a longitudinal cross-sectional view of FIG. 5 whose sections are referenced in FIGS. 3 and 4.

Turning to FIG. 5 one finds an exploded view of housing (1), the ball (7) and a first embodiment of a retainer (6*a*), while in FIG. 6 is a cross section thereof. The housing (1) has a circular protrusion (20*a*) defining the hole in the bottom surface of housing (1), the protrusion (20*a*) having a protrusion lip (22) thereon for seating and holding retainer (6*a*) and the ball (7) therein in place. Retainer (6*a*) in the general shape of a ring has a circular internal ridge for seating and unseating on the protrusion lip (22) by press-fitting thereon. While protrusion (20*a*) is integral with housing (1) and of the same plastic composition, retainer (6*a*) is made of Teflon® to optimize the lubricity necessary to permit free rotation of ball (7) and the flexibility necessary to allow retainer (6*a*) to be press-fitted over protrusion lip (22) and to allow retainer (6*a*) and ball (7) to be removed periodically in order to clean the ball (7). This is shown in more detail in FIG. 6. It should be noted that while plastics other than Teflon® may be employed in the retainers, they do not provide adequate lubricity. Furthermore, while one can envision incorporation of a fluid lubricant source into the device, this is contraindicated when considering increased complexity, cost and possibility of allergic reactions.

It should also be noted that the diameter of the circular opening within housing (1) is slightly distorted to insure that ball (7) while rotating minimizes contact with housing (1) and maximizes contact with retainer (6*a*) to minimize the possibility of any slight sticking or binding between the two dissimilar plastics. The presence of biological fluids, such as lipids, on the surface of human skin provides additional lubricity to enhance the free-rolling character of ball (7) when in use during massaging. The diameter of the bottom opening of retainer (6*a*) is less than that of ball (7) providing enough projection of ball (7) outward from retainer (6*a*) for massaging.

A typical ball (7) for general massage purposes has a diameter of about two inches. However, it should be emphasized that balls and retainers therefor of different generally smaller diameters and openings (not shown) are intended for allowing superior massaging of those parts of the body having muscles difficult to massage with a two inch ball. These retainers/balls can then be easily interchanged as required.

Figure 7:
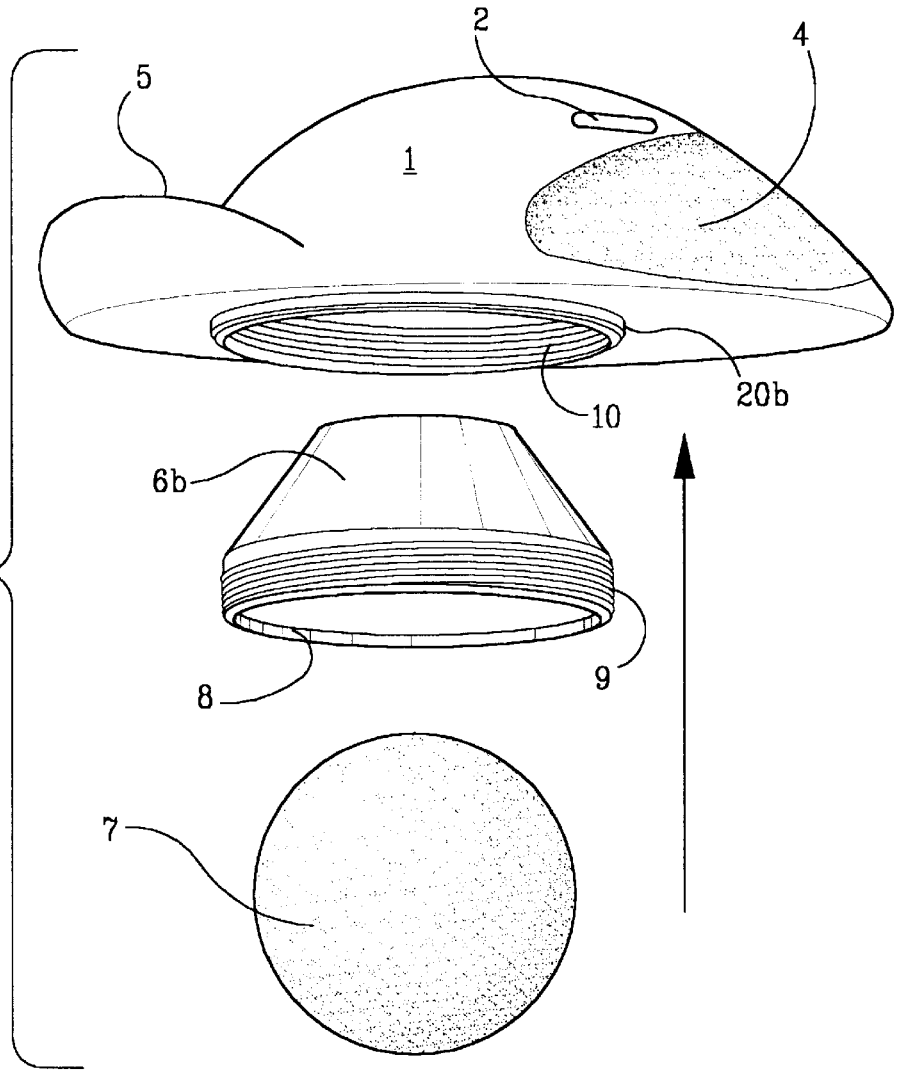
FIG. 7 is an exploded bottom perspective view of a second embodiment of a massager.
Figure 8:
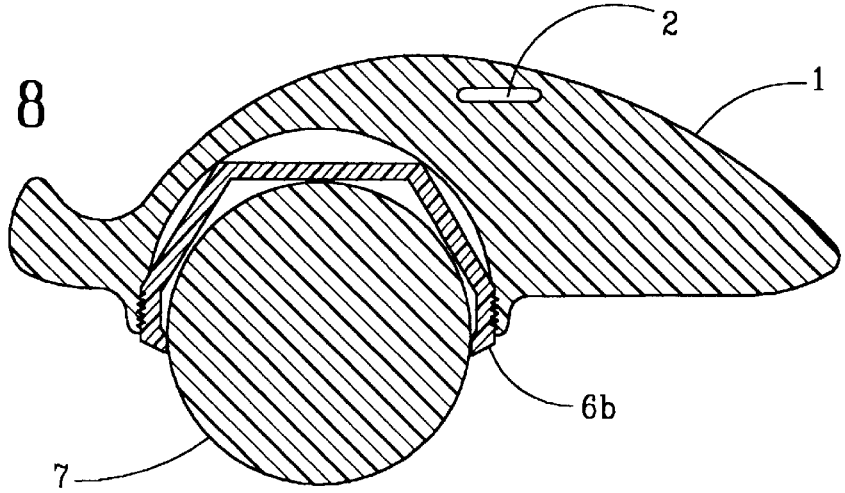
FIG. 8 is a longitudinal cross-sectional view of FIG. 7 whose sections are referenced in FIGS. 3 and 4.

In variations of the basic practice, turning to FIGS. 7 and 8 one finds a second embodiment, a truncated cone retainer (6*b*) and a second type of housing opening having a smaller protrusion (20*b*) with internal threads (10) thereon for seating the external threads (9) of truncated cone retainer (6*b*). While threaded plastics are not the optimum due to their wear characteristics, a conventional twist/lock-in/unlock system (not shown) may also be used. Furthermore, truncated cone retainer (6*b*) has an internal lip (8) for permitting ball (7) to be press fit therein yet allowing ball (7) to freely rotate and also allowing ball (7) to be readily removed therefrom for cleaning purposes. The fact that the structure of truncated cone retainer (6*b*) is of Teflon® insures that ball (7) can only come in contact with Teflon® and not with the dissimilar plastic of housing (1).

Figure 9:
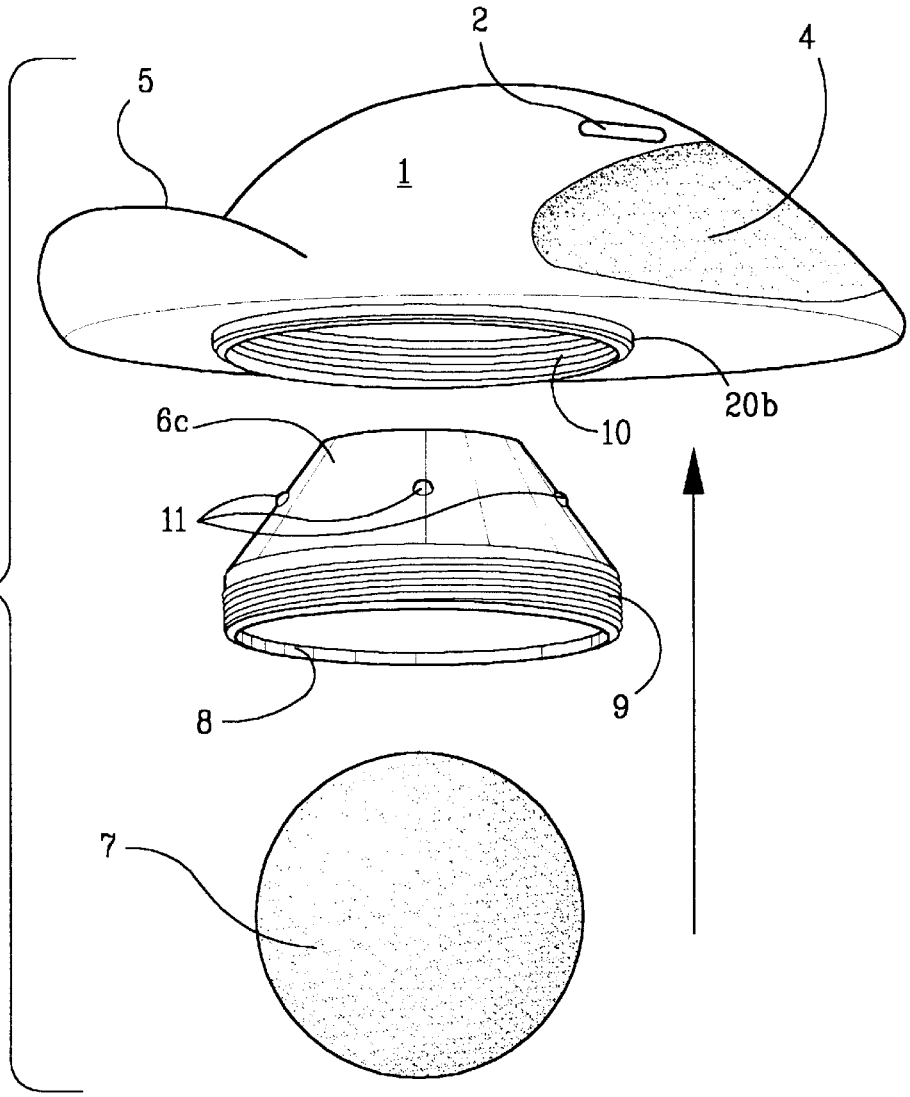
FIG. 9 is an exploded bottom perspective view of a third embodiment of a massager.
Figure 10:
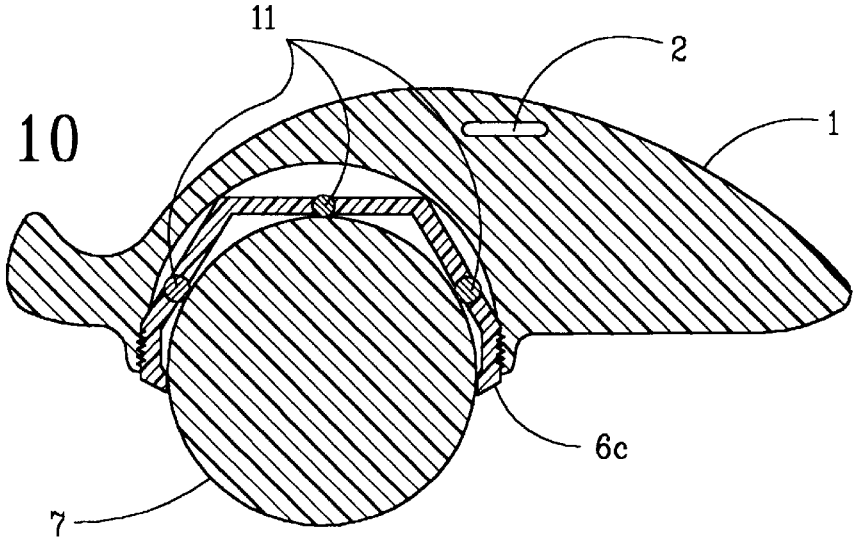
FIG. 10 is a longitudinal cross-sectional view of FIG. 9 whose sections are referenced in FIGS. 3 and 4.

In yet another practice of the invention and to provide even further improvements in free rotatability of ball (7), FIGS. 9 and 10 illustrate a third embodiment, a modification of truncated cone retainer (6*b*), identified as truncated cone having ball bearings therein (6*c*), having a plurality of holes in the truncated cone portion thereof for accommodating Teflon® ball bearings (11). These variations have much to do with the overall cost of manufacture of the device, related primarily to the expensive cost of Teflon®.

Figure 11:
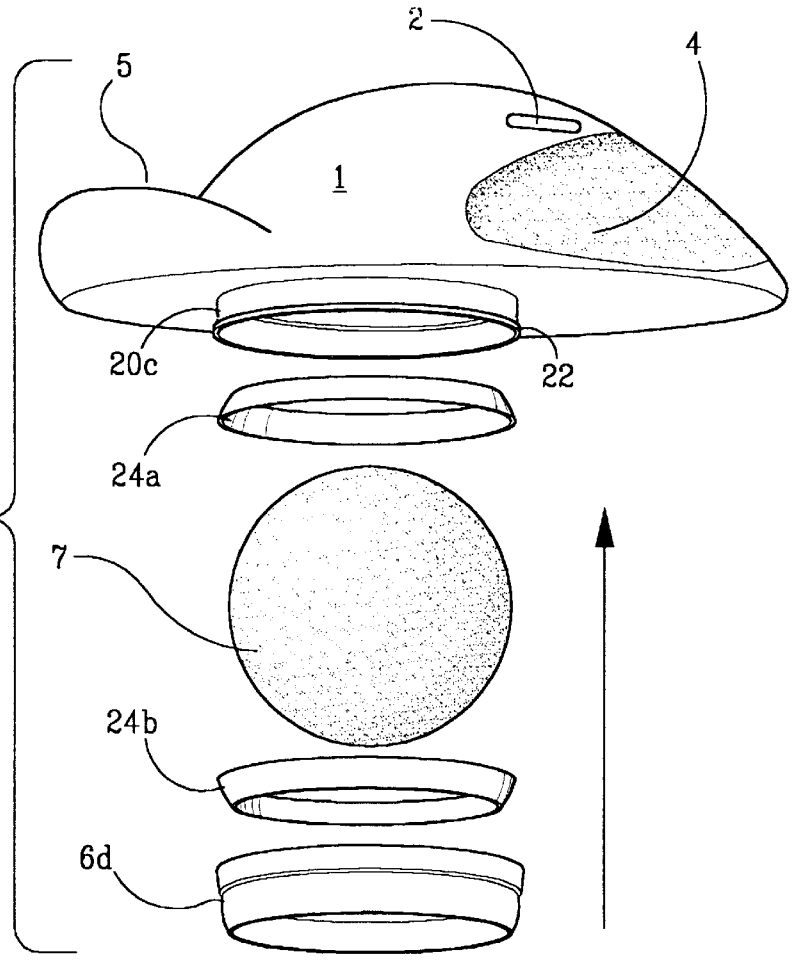
FIG. 11 is an exploded view of the best mode embodiment of a massager.
Figure 12:
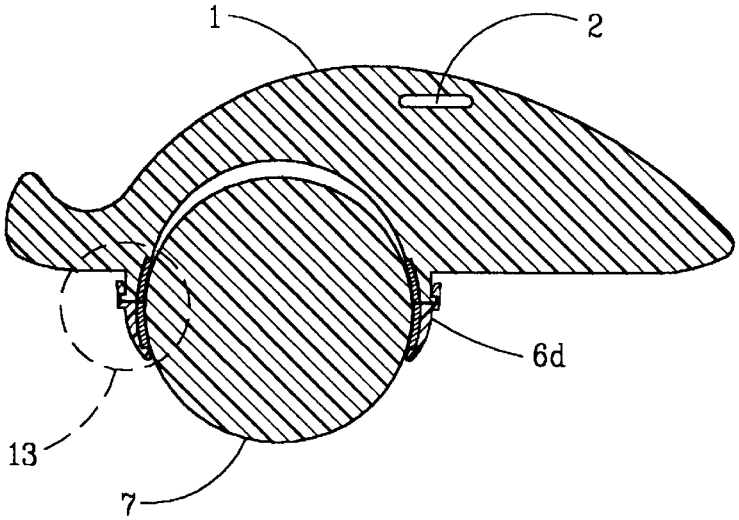
FIG. 12 is a longitudinal cross-sectional view of FIG. 11.
Figure 13:
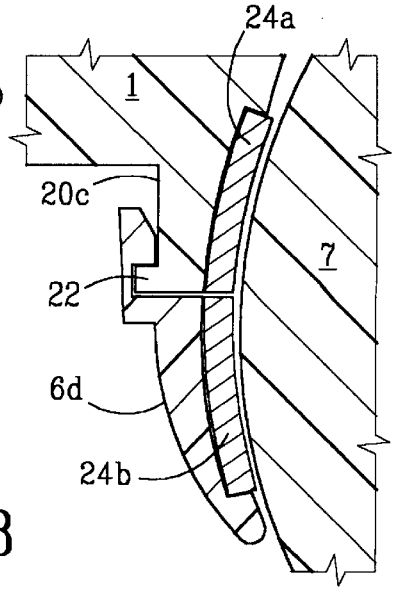
FIG. 13 is a detailed view of the assembled cross-section.

Finally, the best mode envisioned by this invention is shown in FIGS. 11, 12 and 13 wherein protrusion (20*c*) and lip (22) as well as retainer (6*d*) are basically the same as these related elements in FIGS. 5 and 6 with the exception however, that the inside of housing (1) and protrusion (20*c*) have a slot therein for receiving upper ring (24*a*) while retainer (6*d*) having a slot therein for receiving lower ring (24*b*). The upper (24*a*) and lower (24*b*) rings are made of Teflon® and are essentially constructed the same only one is used inverted for the upper while the other is reversed for the lower. It should be noted that the radius of curvature of the hole in the housing/retainer combination varies slightly to insure that ball (7) comes only in contact with Teflon® rings (24*a*) and (24*b*) while employing a minimum of Teflon®.

Since the present invention is constituted as explained above, the meritorious effects of the preferred embodiment are readily achieved by use of a hand-held freely rotatable ball that simulates well the actions of a massager's hand while reducing stress on the massager' hand, wrist and forearm. Furthermore, the ball allows the applied pressure to be focused on the subject where it will do the most good.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hand-held device for implementing massage therapy comprising:

a housing having a first indentation on a top surface thereof shaped to receive four fingers of a hand for directing pressure away from the palm and towards the fingertips, formed with a stop allowing most of the pressure from the user's hand to be forced into the stop for accuracy, stability and precise control in transmitting pressure from the fingers rather than from a wrist and for preventing forward slippage of said fingers, and second and third indentations on sides of the housing shaped to receive a right or left-handed thumb, and having a bottom wall that defines a first circular opening having a concentric circular protrusion associated therewith;

a strap, preferably of nylon webbing, inserted in the top surface of the housing having a hole formed therethrough for threading through said hole for placement across the back of the hand allowing transmission of pressure from the fingers;

a ball freely rotatable in the housing projecting through said first circular opening, said ball being of slightly lesser diameter than said first circular opening; and means for retaining made of tetrafluoroethylene attached to said concentric circular protrusion formed with a second circular opening concentric with said first circular opening of lesser diameter than said ball for retaining said ball in the housing whereby said ball is held captive in the housing and removal from said means for retaining is resisted.

2. The device in accordance with claim 1 wherein the housing is formed from plastics selected from the group consisting of acrylonitrile butadiene styrene, polystyrene and polypropylene.

3. The device in accordance with claim 1 wherein said ball is formed from a material selected from the group consisting of polystyrene, natural rubber and polymerized chloroprene with polystyrene preferred for providing the non-permeable and resiliency properties required for cleanliness, ease of installation and removal from said means for retaining.

4. The device in accordance with claim 1 further comprising a plurality of exchangeable balls and matching means of varying sizes for attaching one of said plurality of balls to the housing of the device for optimizing the beneficial effects of massage on different parts of the body, requiring different size balls, specifically constructed for the neck and trapezius areas as well as for isolated muscles, trigger points, hands, and feet.

5. The device in accordance with claim 1 wherein said means for retaining is a circular ring retainer having on its upper internal portion an overhang for attachment, with said ball protruding therefrom, to said concentric circular protrusion having a lip on the lower outer periphery thereof for seating and unseating said circular ring retainer thereon and thereoff respectively.

6. The device in accordance with claim 5 further comprising a matching pair of tetrafluoroethylene ring inserts, an inverted upper ring and a normally positioned lower ring, wherein the housing, said protrusion, and said circular ring retainer having recessions therein for receiving said upper ring and said lower ring for providing only tetrafluoroethylene contact with said ball.

7. The device in acordance with claim 1 wherein said means for retaining is a circular truncated cone ring having its upper portion a truncated cone and its lower end an externally threaded crown-shaped portion for attachment by threading with internal threads of said concentric circular protrusion of the housing, with said ball being held in place by being press-fitted within said truncated cone ring by an internal lip at its lower extremity, said internal lip being of smaller internal diameter than the external diameter of said ball.

8. The device in accordance with claim 7 wherein said circular truncated cone ring having holes therein, further comprising a plurality of tetrafluoroethylene ball bearings placed within said holes for providing improved lubricity between said ball bearings and said ball.

* * * * *